US009133993B2

(12) United States Patent
Devorris

(10) Patent No.: US 9,133,993 B2
(45) Date of Patent: Sep. 15, 2015

(54) MOISTURE PROTECTED ILLUMINATED LIGHT STRIP

(71) Applicant: Philip Eric Devorris, Altoona, PA (US)

(72) Inventor: Philip Eric Devorris, Altoona, PA (US)

( * ) Notice: Subject to any disclaimer, the term of this patent is extended or adjusted under 35 U.S.C. 154(b) by 275 days.

(21) Appl. No.: 13/626,601

(22) Filed: Sep. 25, 2012

(65) Prior Publication Data

US 2013/0083524 A1 Apr. 4, 2013

Related U.S. Application Data

(60) Provisional application No. 61/541,822, filed on Sep. 30, 2011.

(51) Int. Cl.

| | |
|---|---|
| ***F21S 4/00*** | (2006.01) |
| ***F21V 31/04*** | (2006.01) |
| ***F21V 3/00*** | (2015.01) |
| ***F21S 2/00*** | (2006.01) |
| ***F21V 17/10*** | (2006.01) |
| ***F21V 17/16*** | (2006.01) |
| ***F21V 21/02*** | (2006.01) |
| ***F21V 23/06*** | (2006.01) |
| *F21V 15/015* | (2006.01) |
| *F21Y 101/02* | (2006.01) |
| *F21Y 103/00* | (2006.01) |

(52) U.S. Cl.

CPC .. *F21S 4/008* (2013.01); *F21S 2/00* (2013.01); *F21V 3/00* (2013.01); *F21V 17/104* (2013.01); *F21V 17/164* (2013.01); *F21V 21/025* (2013.01); *F21V 23/06* (2013.01); *F21V 31/04* (2013.01); *F21V 15/015* (2013.01); *F21Y 2101/02* (2013.01); *F21Y 2103/003* (2013.01)

(58) Field of Classification Search

None

See application file for complete search history.

(56) References Cited

U.S. PATENT DOCUMENTS

| | | | | |
|---|---|---|---|---|
| 6,796,680 | B1 * | 9/2004 | Showers et al. | 362/246 |
| 2009/0296381 | A1 * | 12/2009 | Dubord | 362/218 |
| 2010/0157570 | A1 * | 6/2010 | Xiao et al. | 362/35 |
| 2010/0309662 | A1 * | 12/2010 | Zheng | 362/235 |
| 2013/0208476 | A1 * | 8/2013 | Erhard et al. | 362/249.02 |

* cited by examiner

*Primary Examiner* — Ashok Patel

(74) *Attorney, Agent, or Firm* — Schiff Hardin LLP

(57) ABSTRACT

The present invention provides an illumination device having a frame with an upper surface and a pair of opposing walls extending upward from lateral sides of the upper surface, a printed circuit board with a plurality of light emitting diodes that is secured to the upper surface of the device's frame, and an encapsulating material that substantially surrounds the printed circuit board to prevent the printed circuit board from being exposed to moisture and other elements.

19 Claims, 9 Drawing Sheets

MOISTURE PROTECTED ILLUMINATED LIGHT STRIP

CROSS REFERENCE TO RELATED APPLICATION

This application claims priority to U.S. Provisional Application No. 61/541,822, entitled "Modular Moisture Protected Illuminated Decorative Light Strip," filed on Sep. 30, 2011, the contents of which are incorporated herein by reference into the present application.

FIELD OF THE INVENTION

The present invention relates to an illumination device and more particularly to a field-installable light strip device having an encapsulated printed circuit board.

BACKGROUND OF THE INVENTION

Continuing developments in semiconductor light-emitting diodes ("LEDs") have made these devices available for use in a broad spectrum of lighting applications such as roadway lighting, commercial advertisements and the like. In such applications, these LEDs are typically mounted on a printed circuit board. As their use has expanded to the outdoors and other environments, these LEDs and printed circuit boards have been exposed to water, moisture, and other elements, which has caused damage to the LEDs and/or circuit boards and rendered them inoperable.

Existing field-installable light strip devices have attempted to use special processes to remain protected from moisture and water. In particular, these devices exclusively rely on joint seals to prevent water and moisture from entering the device and causing corrosion and improper circuit operation. These joints seals, however, are not always effective and cost efficient and can wear down over time. Accordingly, what is needed is an effective, cost-efficient field-installable light strip device that is designed to enclose and protect the LEDs and printed circuit board from exposure to water and moisture.

SUMMARY OF THE INVENTION

Accordingly, the present invention provides a field-installable illumination device having a frame with an upper surface and a pair of opposing walls extending upward from lateral sides of the upper surface, a printed circuit board with a plurality of light emitting diodes that is secured to the upper surface of the device's frame, and an encapsulating material that substantially surrounds the printed circuit board to prevent the printed circuit board from being exposed to moisture and other elements.

DETAILED DESCRIPTION OF THE INVENTION

Figure 1:
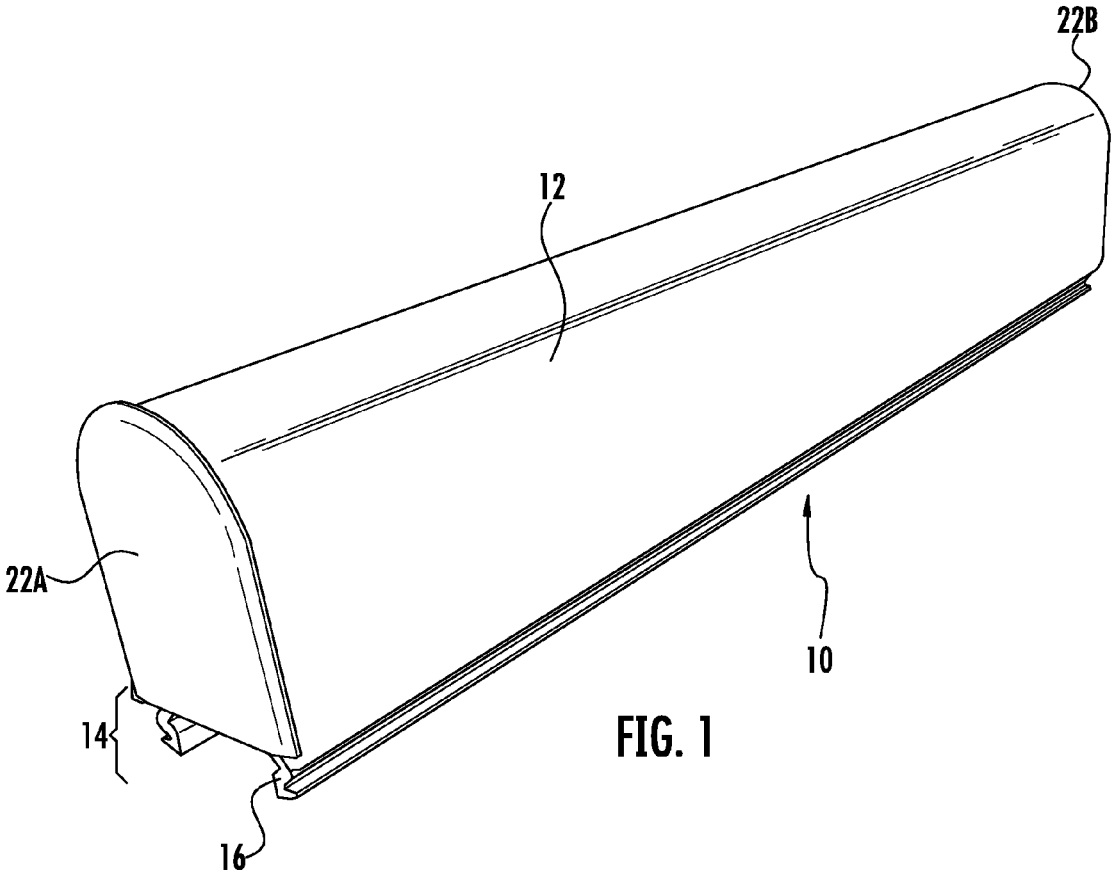
FIG. 1 illustrates an elevated perspective of the illumination device in accordance with an exemplary embodiment of the present invention.

FIG. 1 illustrates an elevated perspective of the illumination device in accordance with an exemplary embodiment. As shown, the illumination device 10 comprises two main components. The first component is lens cover 12, which serves as the light-emitting surface for illumination device 10. Lens cover 12 is preferably a translucent or semi-translucent plastic having two substantially parallel sides and a curved lateral surface at its upper portion to simulate a neon tube lighting element. Lens cover 12 can be manufactured using any conventional manufacturing process, such as extrusion—i.e., by pushing or drawing a compatible plastic resin through a die of a desired cross-sectional profile. In the preferred embodiment, the plastic resin is a colored, polycarbonate or acrylic resin (e.g., blue, green, red, orange, white, yellow, and the like) to simulate, in conjunction with the activated light sources, an illuminated neon tube. Lens cover 12 is also preferably manufactured to have a diffusivity to emit light from the light sources in a manner such that illumination device 10 eliminates any recognizable individual light patterns that originate from the individual light sources. Lens cover 12 is easily removable from illumination device 10, either by sliding or unsnapping the cover to disengage it from the illumination device 10. This enables the installer to quickly and easily change the color of the light that is emitted from the illumination device 10.

The second component of illumination device 10 is main body 14, which generally serves to house the light sources and electrical components. Main body 14 comprises a printed circuit board housing 16, which secures a printed circuit board (not shown) having a plurality of light sources, preferably LEDs. Although the preferred embodiment utilizes LEDs, it should be appreciated to those skilled in the art that any applicable lighting element can be used. Moreover, as will be discussed in detail below, the printed circuit board can be attached to the circuit board housing 16 by any means known to one of ordinary skill in the art—e.g., adhesive, epoxy, double-sided tape, screws, or the like. Further, in the exemplary embodiment, lens cover 12 includes internal flanges at the distal ends of the parallel sides that mate with notches on the upper portion of the circuit board housing 16. Both lens cover 12 and the circuit board housing 16 serve to collectively protect the printed circuit board and its associated LEDs.

Furthermore, endcaps 22A and 22B are secured to each end of illumination device 10 to protect the components against exposure to moisture and the elements and to more effectively simulate a neon tube lighting element. Specifically, endcaps 22A and 22B can be semi-circular plastic pieces formed by injection molding that each includes an internal clear plastic ring or U-shaped member designed to fit within the edges of lens cover 12 and above the two walls 414(*a*) and 414(*b*) (discussed below) of printed circuit board housing 16. As such, endcaps 22A and 22B can be inserted into lens cover 12 and secured by an adhesive or the like to seal in a fluid-tight manner the printed circuit board within lens cover 12 and printed circuit board housing 16. Moreover, endcaps 22A and 22B can comprise a colored outer layer to facilitate simulation of the neon tube lighting element.

Figure 2:
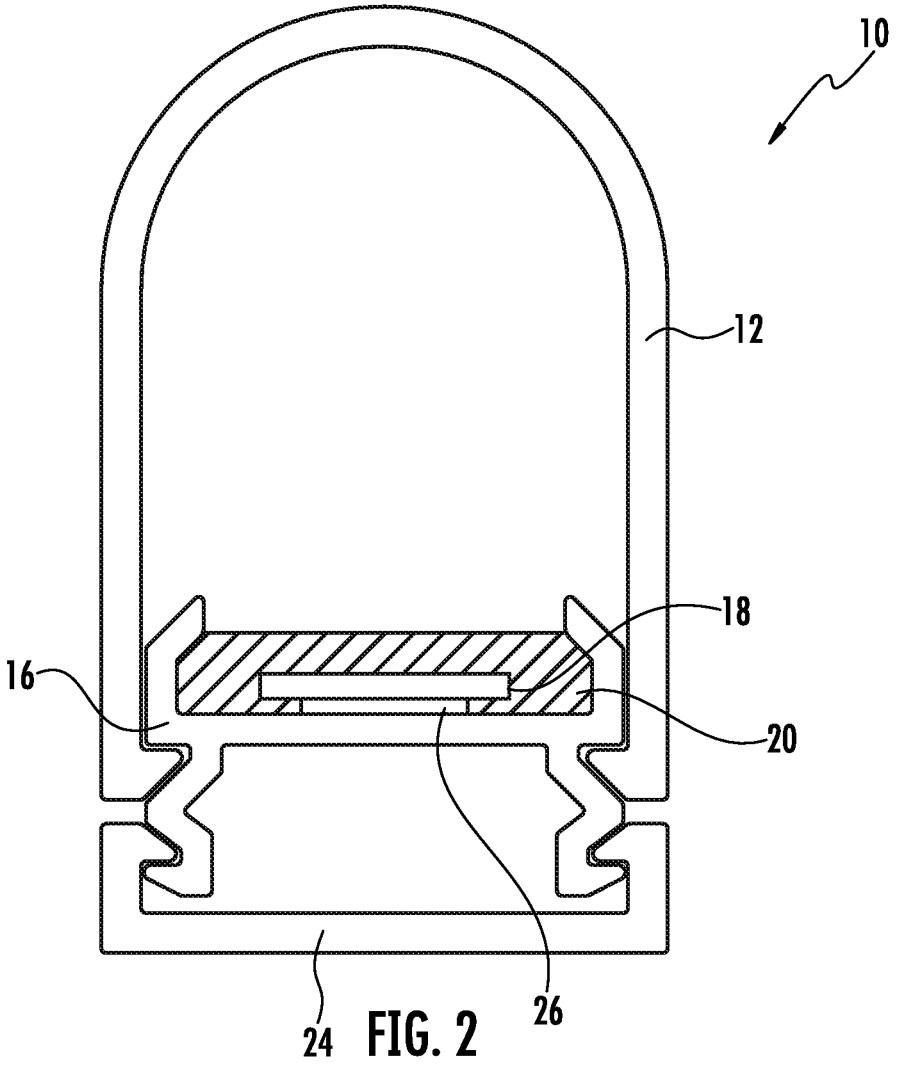
FIG. 2 illustrates a cross-section perspective of illumination device in accordance with the exemplary embodiment of the present invention.

With reference to FIG. 2, a cross-section perspective of illumination device 10 is illustrated in accordance with the exemplary embodiment of the present invention. As shown, lens cover 12 is secured to printed circuit board housing 16 of main body 14 by snapping the inward facing flanges of lens cover 12 to the notches (418(*a*) and 418(*b*) shown below in FIG. 4) of printed circuit board housing 16. Alternatively, the flanges of lens cover 12 can slide laterally over notches of printed circuit board housing 16.

In addition, printed circuit board 18 is inserted linearly into printed circuit board housing 16. In the exemplary embodiment, printed circuit board 18 is secured to printed circuit board housing 16 using a double-sided engineering tape 26 as known to those skilled in the art. Although not shown in FIG. 2, engineering tape 26 can be provided in square sections (e.g., one-half inch section) that are equally spaced apart. For example, a two foot printed circuit board 18 can be attached to circuit board housing 16 using four one-half inches pieces of engineering tape 26 space an equal distance apart from one another. Preferably, the engineering tape is designed to dissipate any static discharges from printed circuit board 18. Alternatively, printed circuit board 18 is secured to circuit board housing 16 using an appropriate adhesive, such as a thermally conductive epoxy that can help dissipate heat away from the LEDs and circuit board during operation. In either embodiment, after printed circuit board 18 is inserted into circuit board housing 16, an encapsulating material 20 is poured over printed circuit board 18 and cured to seal and protect printed circuit board 18 from moisture and/or water intrusion that would otherwise damage the device.

Encapsulating material 20 may be any suitable material for protecting printed circuit board 18—e.g., encapsulating material 20 can be a potting compound, a silicon epoxy, a hygroscopic material, or the like, that serves to absorb and/or protect the printed circuit board from any moisture that enters illumination device 10. In the exemplary embodiment, by providing pieces of engineering tape to secure printed circuit board 18 to circuit board housing 16, a space is defined by the tape between the bottom surface of the printed circuit board 18 and the upper surface of the printed circuit board housing 16, which provides for encapsulating material 20 to cover the underside of printed circuit board 18 during manufacture, effectively ensuring that printed circuit board 18 is fully encapsulated by encapsulating material 20. Furthermore, in one aspect of the exemplary embodiment, printed circuit board 18 can have a width that is slightly narrower than that of printed circuit board housing 16 (e.g., one-sixteenth inch on each side). This feature facilitates encapsulation material 20 to effectively surround and protect printed circuit board 18.

FIG. 2 also illustrates mounting bracket 24, which can be a molded plastic or metal that is manufactured using any suitable manufacturing method (e.g., extrusion). As shown, mounting bracket 24 is secured to printed circuit board housing 16 by a tab and notch locking system. Specifically, during installation, mounted bracket(s) 24 are mounted to a wall using conventional methods such as screws, bolts or the like. Once attached to the wall, the corresponding illumination device 10, and, in particular, printed circuit board housing 16, can be attached to mounting bracket 24. In one embodiment, mounting bracket 24 has a sufficient length (e.g., six inches) to serve as a junction between adjacent printed circuit board housings (discussed in detail below). As a result, the mounting bracket 24 can secure both printed circuit board housings to the wall while also ensuring that they are accurately aligned with one another at the junction.

Figure 3:
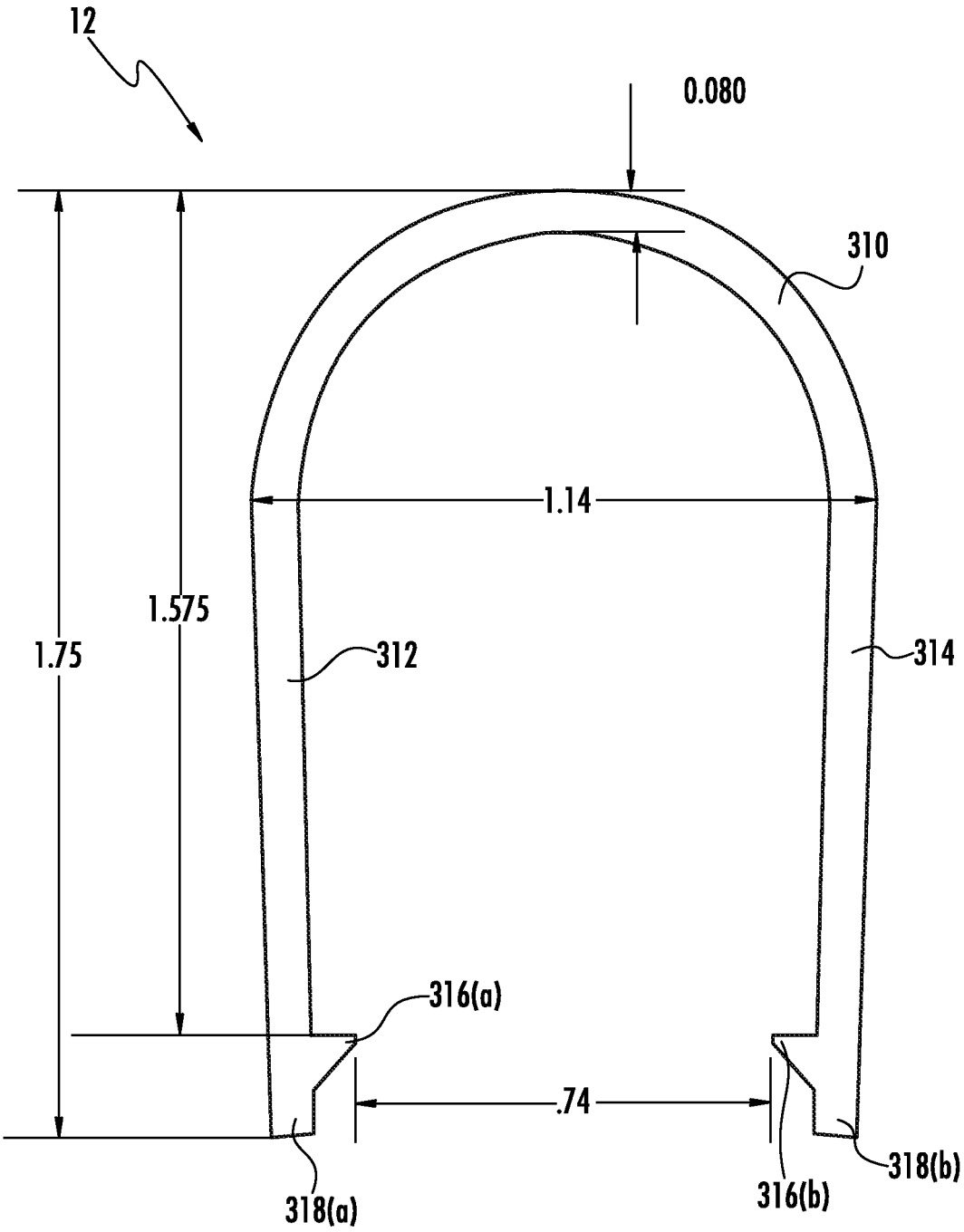
FIG. 3 illustrates a cross-section perspective of the lens cover in accordance with the exemplary embodiment of the present invention.

FIG. 3 illustrates a cross-section perspective of lens cover 12 in accordance with the exemplary embodiment of the present invention. As shown, the upper portion 310 of lens cover 12 is comprised of a curved lateral surface and two substantially parallel sides 312 and 314 extending towards respective ends 318(*a*) and 318(*b*). It should be appreciated that the two sides 312 and 314 may taper slightly inwards or, alternatively, may gradually increase in width as the lengths extend towards the respective ends 318(*a*) and 318(*b*). In addition, as discussed above, the ends 318(*a*) and 318(*b*) of respective sides 312 and 314 each include flange 316(*a*) and 316(*b*) that face inward and are provided to secure lens cover 12 to main body 14 of illumination device 10.

Further, as shown in FIG. 3, lens cover 12 is illustrated with exemplary dimensions of the preferred embodiment. In particular, lens cover 12 is manufactured with a height of approximately 1.75 inches and a width of 1.14 inches. Furthermore, flanges 316(*a*) and 316(*b*) are positioned approximately 1.575 inches from the upper portion 310 of lens cover 12 and their respective ends extend approximately 0.74 inches from one another. Moreover, in the exemplary embodiment, lens cover 12 has a thickness of approximately 0.080 inches. It should be appreciated that while FIG. 3 illustrates preferable dimensions for the exemplary embodiment of lens cover 12, the present invention of illumination device 10 is in no way intended to be limited to these dimensions and, in fact, can be particularly designed and dimensioned to have any varying lengths, widths and/or thickness as desired and suitable for the particular implementation of illumination device 10.

Figure 4:
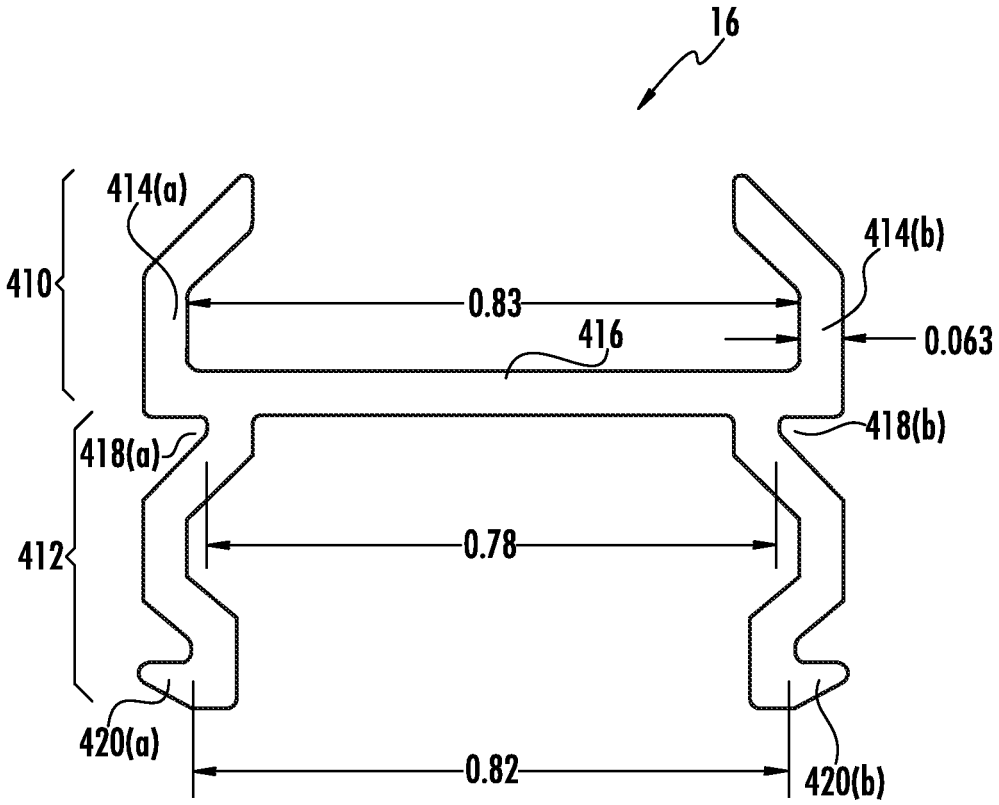
FIG. 4 illustrates a cross-section perspective of the printed circuit board housing in accordance with the exemplary embodiment of the present invention.

FIG. 4 illustrates a cross-section perspective of printed circuit board housing 16 in accordance with the exemplary embodiment of the present invention. Printed circuit board housing 16 can be any appropriate material such as a metal or plastic that is manufactured using any suitable method (e.g., extrusion). If a metal, such as aluminum, is used to manufacture printed circuit board housing 16, and printed circuit board 18 is secured directly to housing 16, the aluminum can serve to dissipate heat generated by the LEDs during operation.

As shown in FIG. 4, printed circuit board housing 16 generally has an upper portion 410 and a lower portion 412. Upper portion 410 includes two walls 414(*a*) and 414(*b*) that, in the preferred embodiment, are tapered inward as they extend vertically. It should be appreciated that walls 414(*a*) and 414(*b*) are necessarily of a sufficient height to secure and protect the LEDs and their associated housing (i.e., printed circuit board 18). Furthermore, a top surface 416 of printed circuit board housing 16 is provided having a sufficient width in which printed circuit board 18 is situated horizontally between vertical walls 414(*a*) and 414(*b*). As shown in FIG. 4, the width of top surface 416 is preferably 0.83 inches, although the present invention is in no way intended to be limited to this dimension. Moreover, lower portion 412 defines two notches 418(*a*) and 418(*b*) and two tabs 420(*a*) and 420(*b*). Notches 418(*a*) and 418(*b*) are provided to receive flanges 316(*a*) and 316(*b*) of lens cover 12, as discussed above, and tabs 420(*a*) and 420(*b*) are provided to secure illumination device 10 to mounting bracket 24. As shown, the width between the two indentations of notches

418(*a*) and 418(*b*) is approximately 0.78 inches in the preferred embodiment and the width between the indentations defined by tabs 420(*a*) and 420(*b*) is approximately 0.82 inches. Again, it is noted that these dimensions are provided to describe the exemplary embodiment, but are in no way provided to limit the printed circuit board housing 16 of the present invention to any specific dimensions.

Figure 5A:
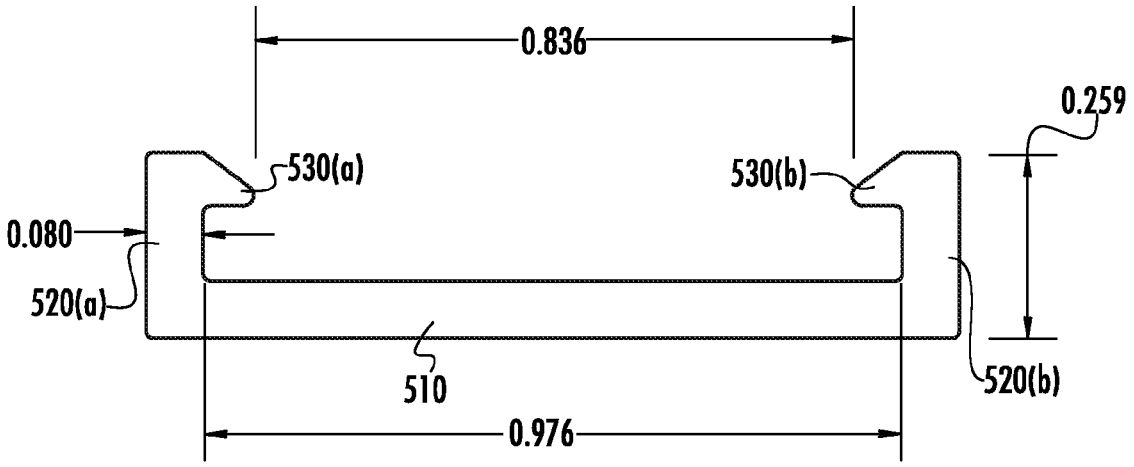
FIGS. 5A and 5B illustrate cross-section perspectives of two mounting brackets in accordance with the exemplary embodiments of the present invention.

FIG. 5A illustrates a cross-section perspective of mounting bracket 24 in accordance with an exemplary embodiment of the present invention. As shown, mounting bracket 24 comprises a base 510, two vertically extending walls 520(*a*) and 520(*b*) and two tabs 530(*a*) and 530(*b*) at the top of the respective walls and pointing inwards. Tabs 530(*a*) and 530(*b*) are provided to catch the two outward facing tabs 420(*a*) and 420(*b*) of printed circuit board housing 16. Moreover, the channel defined between printed circuit board housing 16 and mounting bracket 24, when the printed circuit board 16 is attached to mounting bracket 24, can be used to maintain input/output wires, connector plugs, and the like such that these electrical components are effectively protected from the elements and are also not visible from the outside.

Also, as shown in FIG. 5A, mounting bracket 24 is illustrated with exemplary dimensions. As shown, base 510 is approximately 0.976 inches, each wall 520(*a*) and 520(*b*) has a height of approximately 0.259 inches, and the internal width from tab 530(*a*) to tab 530(*b*) is approximately 0.836 inches. Moreover, mounting bracket 24 has a thickness of approximately 0.08 inches. It is reiterated that these dimensions are provided to describe the exemplary embodiment, but are in no way provided to limit mounting bracket 24 of the present invention to any specific dimensions.

Figure 5B:
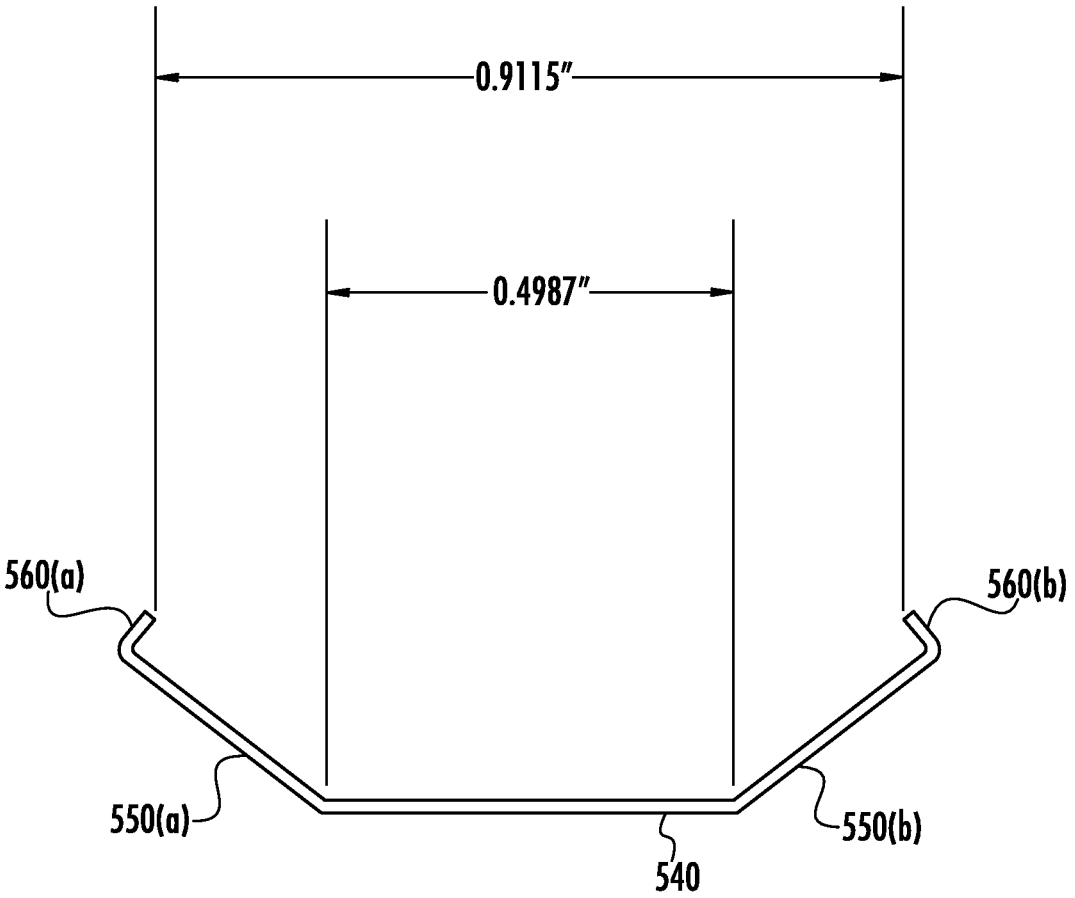

FIG. 5B illustrates a cross-section perspective of an alternative mounting bracket design in accordance with another exemplary embodiment of the present invention. The mounting bracket can be manufactured by an extrusion process using a plastic resin, stainless steel, or any other applicable material as would be known to one of ordinary skill in the art. As shown, the mounting bracket of FIG. 5B comprises a base 540 having a length of 0.4987 inches, two outwardly and diagonally extending walls 550(*a*) and 550(*b*) and two tabs 560(*a*) and 560(*b*) at the top of the respective walls and pointing inwards at approximately 90° from walls 550(*a*) and 550(*b*) and having a distance between them of 0.9115 inches. Similar to tabs 530(*a*) and 530(*b*) of FIG. 5A, tabs 560(*a*) and 560(*b*) are provided to catch the two outward facing tabs 420(*a*) and 420(*b*) of printed circuit board housing 16. It should be appreciated that tabs 420(*a*) and 420(*b*) can be manufactured at an appropriate angle to catch tabs 560(*a*) and 560(*b*) of the mounting bracket shown in FIG. 5B. It again is reiterated that these dimensions are provided to describe the exemplary embodiment, but are in no way provided to limit mounting bracket of FIG. 5B of the present invention to any specific dimensions.

Figure 6A:
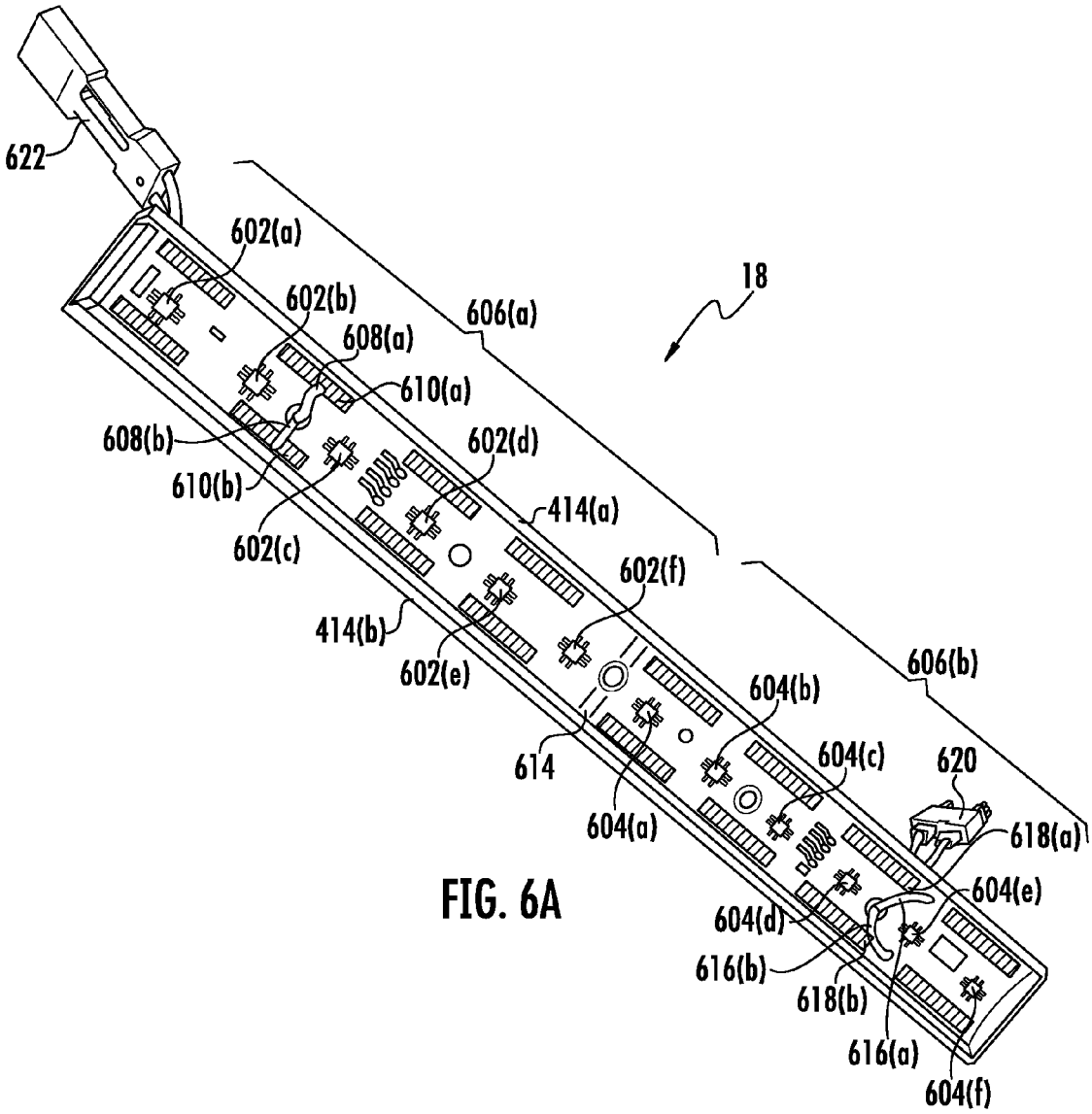
FIG. 6A illustrates a top elevation view of the printed circuit board in accordance with an exemplary embodiment of the present invention.

FIG. 6A illustrates a top elevation view of the printed circuit board 18 mounted within printed circuit board housing 16 in accordance with an exemplary embodiment of the present invention. As shown and described above with respect to FIG. 4, printed circuit board 18 is secured between two vertical walls 414(*a*) and 414(*b*) of housing 16, which serve to protect the printed circuit board 18 by extending above the printed circuit board 18 and providing a hard surfaces covering the printed circuit board 18's edges. Further, printed circuit board 18 is adapted to house a plurality of LEDs 602(*a*), 602(*b*), 602(*c*), 602(*d*), 602(*e*), 602(*f*), 604(*a*), 604(*b*), 604(*c*), 604(*d*), 604(*e*), 604(*f*), as well as the additional circuitry necessary to control and operate the LEDs. It should be appreciated to one of ordinary skill in the art that standard electrical components (e.g., regulators, resistors, diodes, and the like) are provided to enable correct operation of the LEDs, including varying the power supplied to LEDs as needed based on the specific power requirements. However, these components are not described herein in detail so as to not unnecessarily obscure the aspects of the present invention. Further, printed circuit board 18 includes conventional interconnecting conductive traces (not shown) to provide interconnections between the LEDs and additional electrical components.

Printed circuit board 18 can be manufactured with any appropriate length such as, for example, 1 ft., 2 ft., 4 ft., 6 ft., 8 ft. or 10 ft. But for each length, printed circuit board 18 is preferably divided into 6 inch subsections that each includes 6 or 8 LEDs separated by 1 inch. FIG. 6A illustrates an exemplary one foot circuit board (not shown to scale) having subsections 606(*a*) and 606(*b*) each having six LEDs 602(*a*) . . . 602(*f*) and 604(*a*) . . . 604(*f*), respectively, that are arranged linearly with respect to one another. It should be understood that the present invention should in no way be limited to this embodiment (including the total number of LEDs, or number of LEDs per lighting subsection) and/or these dimensions.

As further shown, input wires 608(*a*) and 608(*b*) are connected to connection contacts 610(*a*) and 610(*b*) of subsection 606(*a*) and provided to power the LEDs of printed circuit board 18. Moreover, input wires 608(*a*) and 608(*b*) run through an aperture 612 of printed circuit board 18, through the channel defined by the lower portion of circuit board housing 16 to plug 620. Plug 620 can, in turn, be connected to an external power source, such as a DC power supply having an appropriate voltage. Similarly, subsection 606(*b*) includes an aperture with output wires 616(*a*) and 616(*b*) electrically coupling connection contacts 618(*a*) and 618(*b*) to plug 622. Further, it is noted that in the exemplary embodiment, plug 620 is a male electrical plug with two prongs and plug 622 is a female electrical plug with two sockets for receiving a corresponding male plug. As a result, multiple illumination devices can be connected in series with one another using this standard male plug to female plug connection. It is also noted that while output wires 616(*a*) and 616(*b*) are provided and shown in the exemplary embodiment of FIG. 6A, alternative electrical connection mechanisms that are commonly known to those skilled in the art can be provided to serve as the connection means between adjacent printed circuit boards.

In the exemplary embodiment, each set of six LEDs of each subsection of the printed circuit board 18 is connected in series and each subsection is connected in parallel with one another. For example, LEDs 602(*a*), 602(*b*), 602(*c*), 602(*d*), 602(*e*), 602(*f*), of subsection 606(*a*) are connected in series with one another and subsection 606(*a*) is connected in parallel with subsection 606(*b*). As a result, the installer of the lighting device can cut printed circuit board 18 along a preset cut line, such as cut line 614, to modify the length of the lighting device as necessary, and each subsection of the printed circuit board 18 will still operate independently and correctly. For example, if the installer needs only a six inch lighting device, the installer can cut the device (including the 12 inch printed circuit board) along cut line 614 (e.g., using a circular saw with a 7.25 inch aluminum cutting blade) and either subsection 606(*a*) and/or 606(*b*) can still function, accordingly, assuming each subsection's respective plug 620 or 622 is electrically connected, directly or indirectly, to an external power source. To this end, subsection 606(*b*) is also provided with input wires 616(*a*) and 616(*b*), which are electrically coupled to connection points 618(*a*) and 618(*b*). As a result, if the installer cuts the printed circuit board along cut line 614, plug 620 can be coupled to an external power source, therefore, powering subsection 606(*b*). Because the LEDs for each subsection are connected serially, if the installer cuts at a location other than cut line 614 (e.g., in the middle of a subsection), then the LEDs on that subsection will no longer function when the illumination device is connected to an external power source. Nevertheless, the other subsection(s) will remain functional since they are connected in parallel with the one subsection that is cut.

Figure 6B:
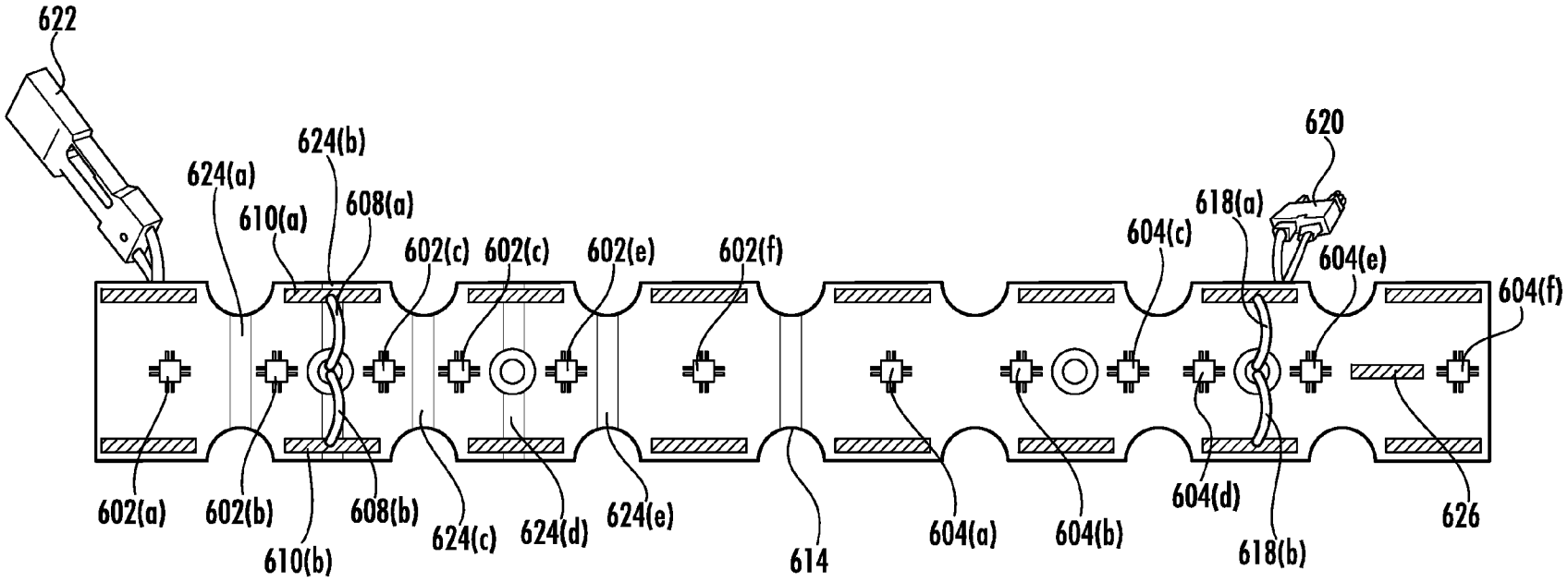
FIG. 6B illustrates a top elevation view of the printed circuit board in accordance with another exemplary embodiment of the present invention.

FIG. 6B illustrates a top elevation view of printed circuit board 18 in accordance with another exemplary embodiment of the present invention. It should be appreciated that many of the components illustrated in FIG. 6A and discussed above are also provided in the embodiment or printed circuit board 18 illustrated in FIG. 6B. Therefore, to the extent these components are not discussed below, it is noted that these components have the same features and functionality as the corresponding components shown in FIG. 6A and discussed above and the description will not be repeated below.

As shown in FIG. 6B, printed circuit board 18 has scalloped edges rather than the straight edges shown in the embodiment of FIG. 6A. As a result, encapsulating material 20 can more easily flow under and around printed circuit board 18, which will prevent most, if not all, voids from forming between printed circuit board 18 and printed circuit board housing 16 during the manufacturing process. Further, subsection 606(*a*) of printed circuit board 18 is provided with five additional cut lines 624(*a*) through 624(*e*), which enable the installer to trim subsection 606(*a*) to a specific length as desired. More particularly, if subsection 606(*a*) has a length of six inches with six LEDs 602(*a*) through 602(*f*) spaced equally one inch apart, each respective cut line 624(*a*) through 624(*e*) is provided between each of the LEDs such that the installer can trim subsection 606(*a*) in one inch increments. Thus, the installer can trim the printed circuit board 18 (subsection 606(*a*) and 606(*b*)) to any length between one and twelve inches, while ensuring that the entire length of the remaining lighting device is lighted consistently throughout. It should be appreciated that the LEDs of subsection 606(*a*) are connected in parallel in this embodiment such that the LEDs of the non-cut section remain operable after subsections 606(*a*) has been trimmed along one of the five additional cut lines 624(*a*) through 624(*e*).

As further shown, subsection 606(*b*) includes an additional connection contact 626 that is adjacent to LED 604(*f*). Connection contact 626 is provided to enable printed circuit board 18 to be cut by the installer next to connection contact 626 and still enable LED 604(*f*) to be electrically reconnected using this additional connection contact. In particular, printed circuit board 18 can be cut and printed circuit board housing 16 can be notched and bent to form a corner that has a separate LED, i.e., LED 604(*f*), illuminating the corner of the location where the light device is being mounted. For example, two notches on printed circuit board housing 16 can be made one inch apart, allowing printed circuit board housing 16 to be bent. Connection contact 626 enables the last LED (i.e., LED 604(*f*)) in the series of LEDs of subsection 606(*b*) to be reconnected to other LEDs in the series, and, effectively, LED 604(*f*) remains powered in the series such that light directly illuminates into the corner section.

It should be appreciated that while certain components of FIG. 6B have not been described with respect to the embodiment shown in FIG. 6A, it is not intended that the two embodiments are exclusive of one another. For example, it is contemplated the features described in the embodiment of FIG. 6A can be implement in the embodiment of FIG. 6B and vice versa. For example, the scalloped edges of the printed circuit board in FIG. 6B and also be implement on the printed circuit board of FIG. 6A and so forth.

Figure 7A:
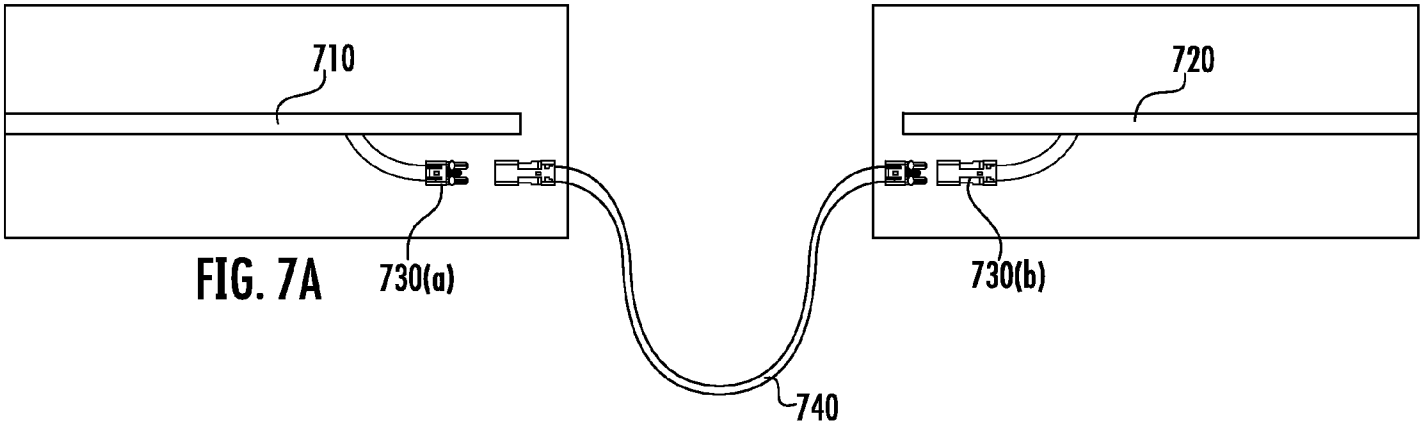
FIGS. 7A through 7C illustrate exemplary wiring connections between two illumination devices in accordance with an exemplary embodiment of the present invention.
Figure 7B:
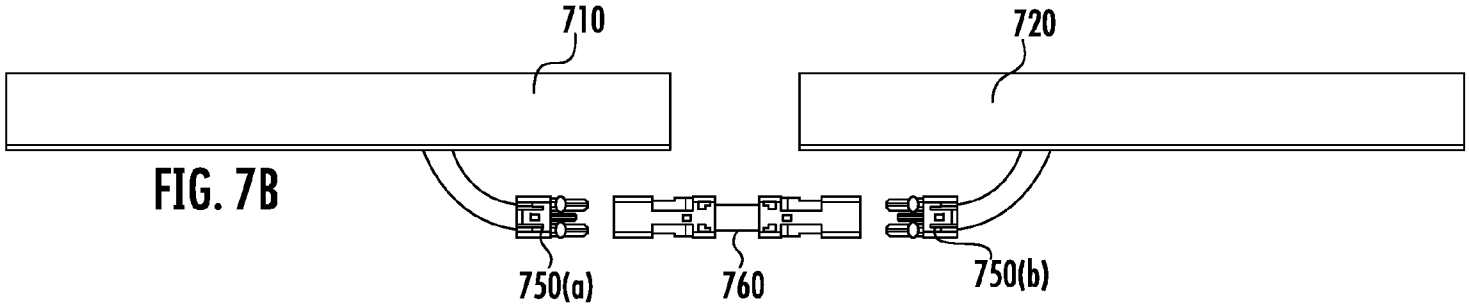
Figure 7C:
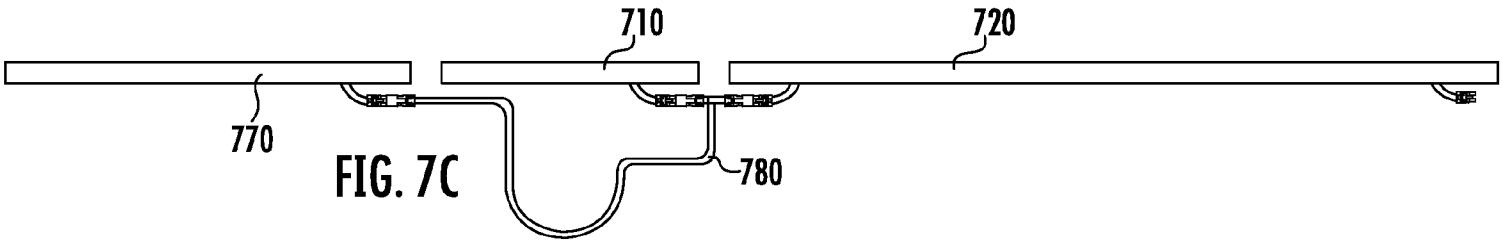

FIGS. 7A through 7C illustrate exemplary wiring connections between two illumination devices in accordance with an embodiment of the present invention. First, as shown in FIG. 7A, illumination devices 710 and 720 are positioned linearly adjacent to one another. It should be appreciated that illumination devices 710 and 720 correspond to the exemplary illumination device 10 as described above with references to FIGS. 1-6. Moreover, illumination device 710 includes input wires coupled to male electrical plug 730(*a*) and illumination device 720 includes output wires coupled to female electrical plug 730(*b*). In order to serially connect illumination device 710 to illumination device 720, an extension cable 740 of appropriate length electrically couples male electrical plug 730(*a*) to female electrical plug 730(*b*). It should be appreciate that while extension cable 740 is shown in the exemplary embodiment, alternatively, if illumination devices 710 and 720 are positioned directly adjacent to one another (e.g., 1 inch apart), male electrical plug 730(*a*) can insert directly into female electrical plug 730(*b*) without using an extension cable 740. It is noted that illumination device 710 shown in FIG. 7A does not illustrate a second electrical connector to be coupled to an external power source. But it should be appreciated that a female electrical plug can be provided on the end opposite male electrical plug 730(*a*) and provided to receive a DC power from an external power source.

As shown in FIG. 7B, illumination devices 710 and 720 each include a male electrical plug 750(*a*) and 750(*b*), respectively, which corresponds, for example, to plug 620 as discussed above with regard to FIG. 6. This scenario may occur if the installer cuts the lighting device along cut line 614 and wishes to attach the resulting subsection with the male electrical plug to another illumination device having a male electrical connector. As shown in this embodiment, a female-to-female adapter 760 is provided to receive each of the male electrical plugs 750(*a*) and 750(*b*). As a result, illumination devices 710 and 720 are electrically coupled to one another in linear fashion.

FIG. 7C illustrates an exemplary embodiment in which Y splitter adapter 780 is provided to couple illumination devices 710 and 720 to a third illumination device 770. Similar to the scenario contemplated for FIG. 7B, this scenario may occur if the field installer cuts the lighting device and disrupts continuity, but also wishes to continue power along a single run of illumination devices. In this example, illumination devices 710 and 770 each have a male electrical plug and illumination device 720 has a female electrical plug as an input from Y splitter adapter 780 as well as a male electrical plug as an outlet. Accordingly, Y splitter adapter 780 is configured to receive electricity from illumination device 770 and, in turn, energize illumination devices 710 and 720. It should be appreciated to one skilled in the art, based on the descriptions of FIGS. 7A through 7C, that multiple illumination devices can be coupled to one another in various configurations based on whether the installer cuts any of the individual illumination devices. By providing illumination devices at various lengths, the installer is capable of configuring the illumination devices in any particular desired design.

While the foregoing has been described in conjunction with exemplary embodiments, it is understood that the term "exemplary" is merely meant as an example. Accordingly, the application is intended to cover alternatives, modifications and equivalents, which may be included within the spirit and scope of the field-installable strip lighting device having an encapsulated printed circuit board as disclosed herein.

Additionally, in the preceding detailed description, numerous specific details have been set forth in order to provide a thorough understanding of the present invention. But it should be apparent to one of ordinary skill in the art that the exemplary moisture protected illuminated light strip described herein may be practiced without these specific details. In other instances, well-known methods, procedures, components, and circuits have not been described in detail so as not to unnecessarily obscure aspects of the apparatus and method disclosed herein.

What is claimed is:

1. An illumination device comprising:

a circuit board housing having an upper surface and a pair of opposing walls extending upward from lateral sides of the upper surface;

a printed circuit board having a plurality of light emitting diodes, the printed circuit board being secured to the upper surface of the circuit board housing; and an encapsulating material substantially encapsulating the printed circuit board with substantially no voids between the encapsulating material and the printed circuit board.

2. The illumination device according to claim 1, further comprising double-sided tape to secure the printed circuit board to the upper surface of the circuit board housing.

3. The illumination device according to claim 2, wherein the encapsulating material is between the printed circuit board and the upper surface of the circuit board housing.

4. The illumination device according to claim 1, wherein the encapsulating material is between the printed circuit board and the upper surface of the circuit board housing.

5. The illumination device according to claim 1, wherein the printed circuit board is divided into a plurality of subsections and each subsection includes a portion of the plurality of light emitting diodes.

6. The illumination device according to claim 5, wherein each of the portion of light emitting diodes are connected in series.

7. The illumination device according to claim 5, wherein each of the plurality of subsections are connected in parallel.

8. The illumination device according to claim 5, wherein at least two of the subsections comprise an electrical connector configured to receive electrical power from an external power source.

9. The illumination device according to claim 8, wherein the at least two subsections can be disconnected from the other subsections of the printed circuit board and the respective portions of the light emitting diodes can be energized by connecting the electrical connector to the external power source.

10. The illumination device according to claim 1, further comprising a lens cover having an inward facing tab on each end of the lens cover, wherein the circuit board housing further comprises an outward facing notch on each lateral side for receiving the respective tabs of the lens cover.

11. The illumination device according to claim 1, further comprising a mounting bracket configured to be secured to a wall.

12. The illumination device according to claim 11, wherein the mounting bracket comprises two walls and inward facing tabs on the distal ends of the two walls, respectively.

13. The illumination device according to claim 12, wherein the circuit board housing further comprises two outward facing tabs configured to secure the lighting device to the mounting bracket.

14. The illumination device according to claim 13, wherein the space defined between the circuit board housing and the mounting bracket is configured to hold electrical cables for the printed circuit board.

15. The illumination device according to claim 10, wherein the lens cover has a diffusivity to emit light from the light sources such that the lens cover eliminates any recognizable individual light patterns that originate from the light emitting diodes.

16. The illumination device according to claim 1, further comprising an electrical contact adjacent one of the plurality of light emitting diodes, wherein the printed circuit board can be cut and bent adjacent to the one of the plurality of light emitting diodes and the electrical contact enables the one of the plurality of light emitting diodes to be electrically reconnected to the remaining plurality of light emitting diodes.

17. The illumination device according to claim 1, wherein the encapsulating material is configured to seal the printed circuit board from moisture intrusion.

18. The illumination device according to claim 1, wherein the encapsulating material is a material selected from the group of materials consisting of a potting compound, a silicon epoxy, a hydroscopic material.

19. The illumination device according to claim 1, wherein the encapsulating material is further configured to absorb moisture from the printed circuit board.

* * * * *